US006398048B1

(12) United States Patent
Kevorkian

(10) Patent No.: US 6,398,048 B1
(45) Date of Patent: Jun. 4, 2002

(54) VENTED BEVERAGE CONTAINER

(76) Inventor: Gregory Kevorkian, 33490 Camino Piedra Rojo, Temecula, CA (US) 92592

( * ) Notice: Subject to any disclaimer, the term of this patent is extended or adjusted under 35 U.S.C. 154(b) by 309 days.

(21) Appl. No.: 08/933,639

(22) Filed: Sep. 19, 1997

(51) Int. Cl.[7] ..... A61J 9/00
(52) U.S. Cl. ..... 215/11.5; 215/11.1; 215/902
(58) Field of Search ..... 215/11.1, 11.4, 215/11.5, 902; 220/703, 745, 705, 711, 371, 372, 373; 210/500.36

(56) References Cited

U.S. PATENT DOCUMENTS 921,387 A * 5/1909 Etter ..... 215/11.5
3,051,993 A * 9/1962 Goldman et al. ... 210/500.36 X
3,768,682 A * 10/1973 Meyers et al. ..... 215/11.5
4,271,977 A * 6/1981 Saigne ..... 220/371
4,618,071 A * 10/1986 Vincent ..... 220/371
4,761,232 A * 8/1988 Bright ..... 210/500.36
4,778,601 A * 10/1988 Lopatin et al. ..... 210/500.27
4,828,772 A * 5/1989 Lopatin et al. ..... 264/45.9
4,865,207 A * 9/1989 Joyner et al. ..... 215/11.5
5,143,614 A * 9/1992 Soria et al. ..... 210/321.61
5,238,569 A * 8/1993 Soria et al. ..... 210/500.27
5,542,670 A * 8/1996 Morano ..... 215/11.5 X
5,725,645 A * 3/1998 Wickland et al. ..... 220/371
5,727,707 A * 3/1998 Wickland et al. ..... 220/327

* cited by examiner

*Primary Examiner*—Stephen P. Garbe
*Assistant Examiner*—Tri M. Mai
(74) *Attorney, Agent, or Firm*—Doug Burcombe

(57) ABSTRACT

A beverage container is provided with a hydrophobic vent consisting of a relatively thick and rigid disc-shaped piece of macroporous plastic having pore sizes averaging from 7–350 microns. The vent can be welded, molded or secured to the sidewall, bottom or cap of a plastic beverage container thus eliminating all moving parts. The macroporous plastic is resistant to oxidative abrasion, contamination and wetting and is strong enough to resist breakage. In one embodiment a baby bottle is provided which consists of a plastic bottle body, a nipple, and means for fastening the nipple to the bottle body. The bottle body is provided with a macroporous plastic vent which can be welded, molded or secured to the sidewall or bottom of the bottle body thus eliminating all moving parts. The bottle body can be washed repeatedly as a single unit with the vent intact.

20 Claims, 2 Drawing Sheets

VENTED BEVERAGE CONTAINER

The invention relates to beverage containers and more particularly to beverage containers which are vented for the purpose of reducing negative pressure or vacuum which builds up inside the container when a beverage is being consumed therefrom.

BACKGROUND

A large variety of beverage containers are constructed with a small opening or drinking spout through which the fluid contents can be extracted. The opening is adapted so that a person can place their mouth over the opening thus forming a seal around the opening. Examples of these types of beverage containers include: a soda-pop bottle having a small annular opening; a drinking cup or spill-proof cup having a cover formed with a drinking spout; and, a nipple-equipped baby bottle. As the fluid contents are being consumed from one of these beverage containers, a negative pressure or vacuum builds up within the container making it necessary to interrupt drinking long enough to allow air to enter into the container equalizing the pressure between the outside and inside atmospheres. This interruption causes inconvenience for adult drinkers and makes it difficult for babies to continue feeding. Numerous solutions have been proposed whereby the beverage container is vented to relieve the buildup of negative pressure. As one would expect, most of the solutions are directed to spill-proof cups or baby bottles for feeding infants.

A number of solutions rely on complicated mechanical valves such as that disclosed in U.S. Pat. No. 5,079,013 to Belanger. Belanger discloses a dripless baby bottle vented by means of two spring-biased check valves. Generally speaking, mechanical valves require a number of parts which make such containers difficult to manufacture, assemble and clean.

A different type of solution is disclosed in U.S. Pat. No. 4,865,207 to Joyner wherein a vent made from a woven microporous membrane allows air to pass into a baby bottle. The thin membrane is enclosed between two plastic grid plates that provide structural support and protection for the membrane. The membrane assembly is then fastened against the bottom of the baby bottle by a threaded screw cap. These membranes typically have from one million to nine million pores per square inch (a macroporous vent will have substantially less than one million pores per square inch). The large number of micropores increase the surface area susceptible to oxidatiot, contamination and wetting. Furthermore, the small pores tend to retain surfactants after washing with surfactants. The residual surfactants reduce surface tension making the membrane susceptible to wetting and leaking. Due to the thinness of the fabric, the membrane can be easily damaged. The large number of parts involved also make the container more difficult to manufacture, assemble and clean.

Another solution involves a baby bottle with a vent consisting of a pressure equalizing apertured elastomeric diaphragm member as disclosed in U.S. Pat. No. 5,499,729 to Greenwood. The elastomeric diaphragm is held against the bottom of the bottle by a screw cap. During feeding, negative pressure forces the diaphragm to stretch inward whereby small holes in the diaphragm open up allowing air to pass into the bottle. The diaphragm must be removed as a separate piece for cleaning. Again, the screw cap and diaphragm comprise additional structural elements that make the bottle more expensive to manufacture.

Finally, U.S. Pat. No 5,339,971 to Rohrig, discloses a one piece molded baby bottle in which 150 to 200 pores are burned into the base of the bottle by means of a laser. The diameter of the pore openings on the inside of the bottle wall range from 3 to 7 micrometers which is small enough to prevent the passage of water but large enough to allow the passage of air under negative pressure. The diameter of the pore openings on the outside surface of the bottle are from 50 to 100 micrometers such that each pore forms a conical shaped channel connecting the inside and outside surfaces. This baby bottle is easier to clean than the previously described bottles and requires no moving parts, but the manufacturing process related to burning in the large number of pores is obviously complicated and expensive. Furthermore, the small pore openings are susceptible to oxidative abrasion. Once the pore openings become abraded, the fluid contents can leak out.

In view of the shortcomings associated with each of the previous examples, a need still exists for a durable, one piece, vented beverage container that is easy to clean, resistant to corrosion and contamination, and simple to manufacture. The present invention is believed to meet this need.

SUMMARY OF THE INVENTION

In accordance with the invention, a beverage container is provided with a hydrophobic vent consisting of a rigid disc-shaped piece of macroporous plastic being 0.025" to 0.25" thick and having pore sizes averaging from 7–350 microns. The vent can be welded, molded or secured to the sidewall, bottom or cap of a plastic beverage container thus eliminating all moving parts. The macroporous plastic is resistant to oxidative abrasion, contamination and wetting and is strong enough to resist breakage. In one embodiment a baby bottle is provided which consists of a plastic bottle body, a nipple, and means for fastening the nipple to the bottle body. The bottle body is provided with a macroporous plastic vent which can be welded, molded or secured to the sidewall or bottom of the bottle body thus eliminating all moving parts. The bottle body can be washed repeatedly as a single unit with the vent intact.

DETAILED DESCRIPTION

Figure 1:
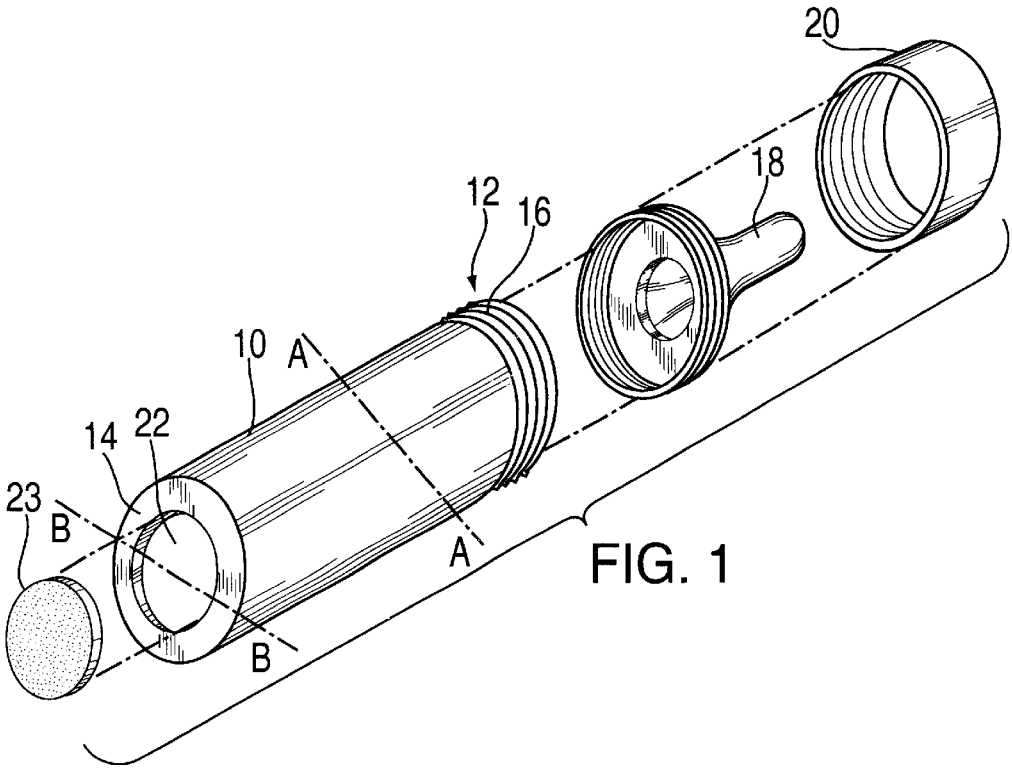
FIG. 1 is an exploded perspective view of a baby bottle showing the plastic bottle body, the vent, the nipple, and threaded ring in positional relationship to each other.

As shown in FIG. 1, a baby bottle is conventional in appearance consisting of an elongated cylindrical bottle 10 having an open end 12 and a partially closed end 14. The bottle body is formed from a thermoplastic polymer such as polypropylene, polyethylene or polycarbonate by processes known in the art such as blowmolding or injection molding. The bottle body is formed with a threaded lip 16 at its open end 12 so that a conventional elastomeric nipple 18 can be clamped against the top of the bottle by a threaded ring 20 which is screwed onto the threaded lip 16 of the bottle. The partially closed end 14 of the bottle body is formed with a hole 22 for receiving a vent 23. The vent would be secured in the hole by one of the methods discussed below.

The vent 23 is made from macroporous plastic. Plastic herein is defined as one of a variety of hydrophobic thermoplastic polymers including high-density polyethylene (HDPE), ultra-high molecular weight polyethylene (UHMW), polypropylene (PP), polyvinylidene fluoride (PVDF), polytetrafluoroethylene (PTFE), nylon 6 (N6) and polyethersulfone (PES).

It is known to make macroporous plastic by a process called sintering wherein powdered, or granular thermoplastic polymers are subjected to the action of heat and pressure to cause partial agglomeration of the granules and formation of a cohesive macroporous sheet. The macroporous sheet is comprised of a network of interconnected macropores which form a tortuous path through the sheet. Typically, the void volume of a macroporous sheet is from 30 to 65% depending on the conditions of sintering. Due to surface tension, liquids cannot penetrate the small pores at the surface of the sheet but air can readily pass through. U.S. Pat. No. 3,051,993 to Goldman, herein incorporated by reference, discloses the details of making a macroporous plastic from polyethylene.

Macroporous plastic, suitable for making a vent in accordance with the invention, can be manufactured in sheets or molded to specification and is available for purchase from a number of sources. Porex Technologies Corporation, 500 Bohannon Road, Fairburn, Ga. 30213-2828, is one such source and provides macroporous plastic under the trademark, "POREX." Macroporous plastic manufactured under the name POREX can be purchased in sheets or molded to specification from any one of the thermoplastic polymers previously described. The average porosity can vary from 7 to 350 microns depending on the size of polymer granules used and the conditions employed during sintering.

The basic size, thickness and porosity of the plastic used to make the vent is determined by calculating the amount of air that must pass through the vent in a given period of time (flux rate). The flux rate of a given macroporous plastic varies depending on the average porosity, thickness and size of the plastic and is measured in terms of cubic centimeters per minute per square centimeter ($cm^3/min/cm^2$). For purposes of the invention, the flux rate of the vent must assure that the volume of air per minute that passes through the vent equals or exceeds the volume of beverage per minute that is removed from the container by the drinking action of an infant or adult. In the case of an infant, a flux rate of 100 $cm^3/min/cm^2$ is sufficient whereas for most adults under normal drinking conditions, a flux rate of 500 $cm^3/min/cm^2$ is sufficient.

A vent achieving a flux rate of 50 $cm^3/min/cm^2$ to greater than 1000 $cm^3/min/cm^2$ can be made by die cutting or stamping out a plastic disc from a sheet of macroporous polypropylene having an average pore size of 125 microns and a void volume or 35–50%. The size of the disc is preferably 0.025" to 0.25" thick by 0.10" to 2.00" in diameter. The disc could also be molded to the same or similar dimensions using polypropylene.

Figure 2A:
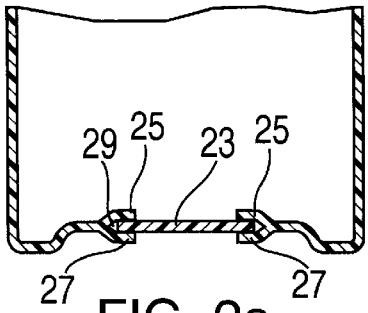
FIG. 2*a* shows a cross section of the closed end of the bottle body showing the vent secured to the bottle body by injection molding (see line A, FIG. 1 for plane of section for views 2*a*–2*d* and line B, FIG. 1 for cut-off line defining the lower part of bottle in views 2*a*–2*d*).

Once the macroporous vent is obtained, the vent can be secured to the plastic bottle body by any one of a number of methods which are known in the art. In one embodiment, the vent is molded into a cavity which is formed in a wall of the bottle as the bottle is being injection molded. With reference to FIG. 2*a*, an example is shown wherein the hole-forming detail molded into the bottle wall consists of an inner and outer lip 25 & 27 defining a circular cavity 29 having an inside dimension which corresponds to the outside dimension of the vent 23. Prior to injection molding, the vent 23 would be positioned in the injection mold such that when molten plastic is injected into the mold, the lip detail will form in the bottle wall around the edges of the vent such that a leak proof seal is created between the bottle wall and the vent with the vent being permanently secured in place.

Figure 2B:
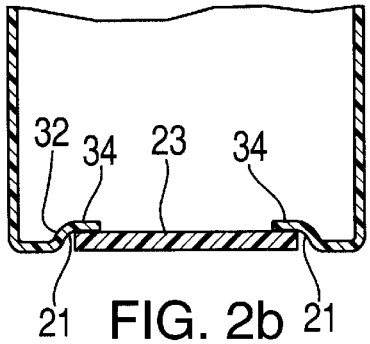
FIG. 2*b* is a cross-sectional side view of the closed end of the bottle body showing the vent secured to the bottle body by welding, sealant or sonic sealing.

In a second embodiment, the bottle body is blow molded or injection molded with a hole. The hole-forming detail in the bottle wall could consist of a circular depression 21 as shown in FIG. 2*b*. A vent disc 23, dimensioned to fit snugly against the sides 32 and bottom 34 of the depression 21, is secured in place using means known in the art such as ultrasonic sealing or welding. In the case of welding, the edges of the vent and bottle wall that are to be welded together are subjected to a heat source until melted and then the edges butted together and clamped in place until cool. Low temperature heating suitable for welding can be accomplished using one of the following: plastics hot-air gun, hot-air blower, infrared heat lamp, radiant tube, wire, or ribbon; or spin-welding techniques.

During any welding, heating or molding process, it is important to limit the application of heat to the edges of the vent so that the porous characteristics of the vent are not altered anywhere except at the edges of the vent.

The vent can also be secured in place using a sealant. The type of sealant used depends on the ability of the sealant to bond with or penetrate the pores of the plastic. One example uses PVC & ABS cement to mechanically bond PP to PVC, styrene or ABS. In certain applications, two-part epoxy systems or silicone may be used to secure the vent in place. Ultrasonic sealing or welding are preferred over sealants.

Figure 2C:
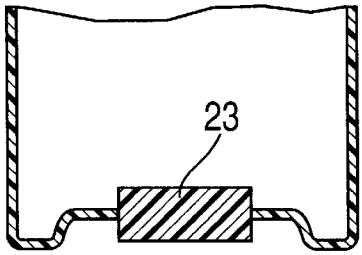
FIG. 2*c* is a cross-sectional side view of the closed end of the bottle body showing the vent formed as a plug and inserted into a hole formed in the bottle body.
Figure 2D:
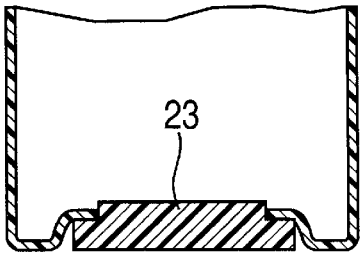
FIG. 2*d* is a cross-sectional side view of the closed end of the bottle body showing the vent formed as a plug with a shoulder and inserted into a cavity formed in the bottom of the bottle body.

With reference to FIG. 2*c* and FIG. 2*d*, the vent can also be formed as a plug 23 which can be inserted into a hole 22 formed in the wall of the bottle during blow molding or injection molding of the bottle body. In this embodiment, the plug would be formed from PTFE and the plug 23 would have an outside diameter slightly larger than diameter of the hole 22. In order to insert the plug into the hole the plug would be subjected to low temperature by exposing the plug to liquid nitrogen. The cold temperature would cause the plug to shrink enough that the plug can be easily inserted in the hole. Upon warming, the plug would expand to its original size thus plugging the hole and forming a water tight seal between the bottle wall and the plug. The plug could also be press fit into the bottle.

It would also be possible to use one of the methods described above to secure the vent to a threaded, plastic screw cap similar to the threaded ring 20 used to clamp the nipple onto the open end of the bottle. In this case, the bottle would comprise an elongated tube threaded at each end. The nipple could be clamped to one end of the bottle using the threaded ring and a threaded screw cap provided with a macroporous vent could be threaded on the other end of the bottle body.

Figure 3:
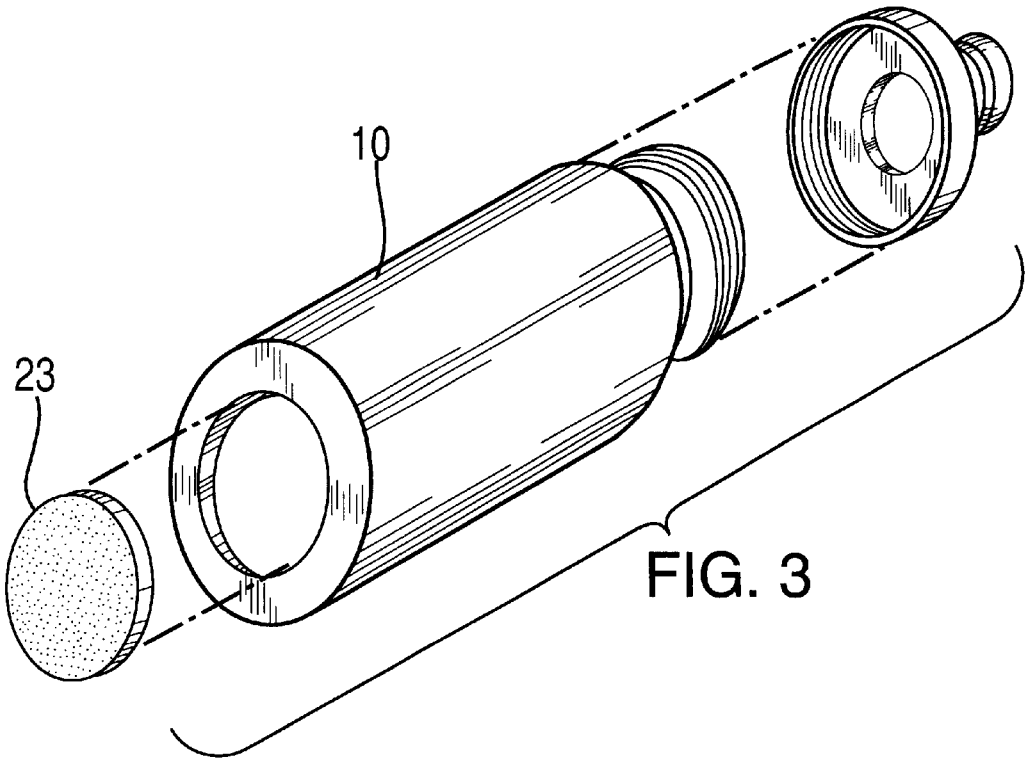
FIG. 3 is an exploded perspective view of a sports bottle with a vent shown in positional relationship to the bottom of the bottle.

The same methods used to secure the vent to the baby bottle body are also used to secure the vent to the plastic bodies of other kinds of beverage bottles or beverage containers. As before, the bottle or container is formed from plastic by processes known in the art such as blowmolding or injection molding. Examples of these types of bottles or containers would include soda-pop bottles, water bottles, sports bottles and canteens. With reference to FIG. 3, a water bottle 36 is shown with a vent 23 secured in the base.

Figure 4:
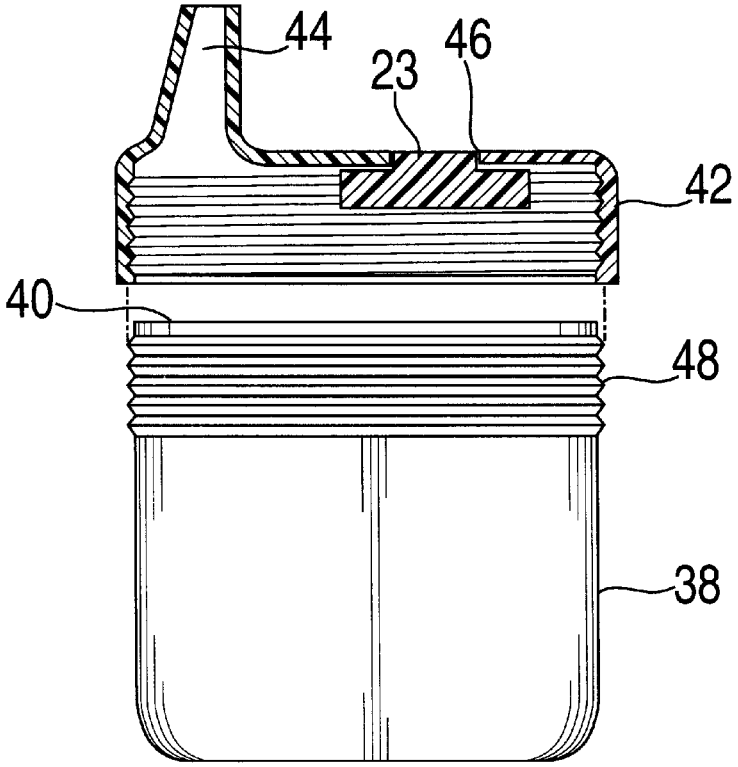
FIG. 4 is a cross-sectional side view of a screw-on lid for a drinking cup showing a vent secured to the inner surface of the cap by welding, sealant or sonic sealing.

It would also be possible to use one of the methods described above to secure the vent to a plastic cover for a drinking cup. With reference to FIG. 4, a drinking cup 38 is threaded at its open end 40. A plastic cover 42 is formed with a rigid drinking spout 44 to one side, a hole forming detail 46 to the other side, and threads 48 for clamping the cover to the cup. The vent 23 would be secured in the hole 46 using one of the above described securing methods. Both the cup and the cover are formed from plastic by processes known in the art such as blowmolding or injection molding.

Two of the previously discussed methods used to secure the vent to a plastic bottle body can also be used to secure the vent to a glass or metal beverage container. In the case of glass, i.e., a soda pop bottle, the bottle would be molded with a hole-forming detail as previously described and the plastic vent would be secured therein using sealant or the cold-shrink method. The same holds true with a metal beverage container whereby the container can be molded with a hole-forming detail and the vent can be secured therein using sealant or the cold-shrink method.

In an alternative embodiment, the vent can also be formed from metal or glass by sintering powdered glass or metal under selected conditions of heat and pressure causing partial agglomeration of the granules and formation of a cohesive macroporous substrate. Depending on the conditions chosen, an average porosity of 7 to 350 microns and a void volume of 30 to 65% can be achieved. The glass or metal must be rendered hydrophobic either prior to the molding process or subsequent to the molding process using surface modification agents such as organosilanes. The size, thickness and porosity of the vent is determined as previously described by calculating the flux rate. The sintering conditions and mold dimensions can then be conformed to yield a vent having the necessary properties. The glass or metal vent can be secured to a glass, metal, or plastic container using either the sealant or cold-shrink methods discussed above.

The embodiments described herein utilize a disk-shaped vent. While the disc shape is preferred for both ease of manufacturing and functional efficiency, it is possible to use vents of different shapes, e.g., oval or rectangular. The only limitation in shaping the vent is that the shape should not prevent the vent from being secured in a leak-proof manner using one of the securing methods disclosed above.

Although each of the examples described herein locate the vent in the closed end of the bottle, the vent could just as easily be located along the sidewall of the bottle using one of the securing methods previously described and said embodiments are contemplated.

The present embodiments as herein described are considered in all respects to be illustrative and not restrictive; the scope of the invention being indicated by the appended claims rather than by the foregoing description. All changes which come within the meaning and range of equivalency of the claims are intended to be embraced therein.

I claim:

1. A vented beverage container of the type having a drinking spout and a vent where said vent is made from a sintered macroporous substrate and said vent is permanently secured to the container so the container and vent form an integral one piece unit.

2. A vented beverage container according to claim 1 wherein the macroporous substrate has pore sizes ranging from 7 to 350 microns.

3. A vented beverage container according to claim 2 wherein said vent is disc or plug shaped.

4. A vented beverage container according to claim 3 wherein said disk-shaped vent is from 0.025" to 0.25" thick.

5. A vented baby bottle wherein said baby bottle is the type that utilizes a nipple and a vent and said vent is made from sintered macroporous plastic permanently secured to said bottle so said bottle and vent form an integral one piece unit.

6. A vented baby bottle according to claim 5 wherein the macroporous plastic has pore sizes ranging from 7 to 350 microns.

7. A vented baby bottle according to claim 6 wherein said vent is disc or plug shaped.

8. A vented baby bottle according to claim 7 wherein said vent is from 0.025" to 0.25" thick.

9. A vented baby bottle wherein said baby bottle comprises a plastic bottle body, a nipple, means for securing said nipple to said bottle body, a sintered macroporous plastic vent, and means for permanently securing said vent to said bottle body so said vent and bottle body form an integral one piece unit.

10. A vented baby bottle according to claim 9 wherein the macroporous plastic has pore sizes ranging from 7 to 350 microns.

11. A vented baby bottle according to claim 10 wherein said vent is flat and disc shaped.

12. A vented baby bottle according to claim 11 wherein said vent is from 1/16" to 1/4" thick.

13. A vented baby bottle according to claim 12 wherein said vent is secured to the bottle body by heat welding, injection molding, sealant, sonic welding, or insertion.

14. A plastic bottle body for use in a vented baby bottle where said baby bottle consists of said plastic bottle body, a nipple, and means for securing said nipple to said bottle body and said bottle body has permanently secured therein a sintered macroporous plastic vent whereby said bottle body and said vent form an integral one piece unit.

15. A plastic bottle body according to claim 14 wherein said macroporous plastic has pore sizes ranging from 7 to 350 microns.

16. A plastic bottle body according to claim 15 wherein said vent is flat and disc shaped.

17. A plastic bottle body according to claim 16 wherein said vent is from 0.025" to 0.25" thick.

18. A plastic bottle body according to claim 17 wherein said vent is secured to the bottle body by heat welding, injection molding, sealant, sonic welding, insertion.

19. A method of making a plastic bottle body for use in a vented baby bottle wherein said baby bottle consists of said plastic bottle body, a nipple, and means for securing said nipple to said bottle body and said bottle body has permanently secured therein a sintered macroporous plastic vent so said vent and said bottle body form and integral one piece unit, said method comprising the steps of:

providing a plastic bottle body having a hole therein for receiving said vent;

providing a sintered macroporous plastic vent; and, permanently securing said vent in said hole.

20. A vented beverage container according to claim 1 wherein said vent is permanently secured to the drinking spout such that the drinking spout and the vent form an integral one piece unit.

* * * * *

UNITED STATES PATENT AND TRADEMARK OFFICE

CERTIFICATE OF CORRECTION

PATENT NO. : 6,398,048 B1 
DATED : June 4, 2002
INVENTOR(S) : Gregory Kevorkian, Dan Smolko and Vladimir Levitin It is certified that error appears in the above-identified patent and that said Letters Patent is hereby corrected as shown below:

Title page,
Item [76], please add the following inventors:
-- Dan Smolko, San Diego, CA
Vladimir Levitin, Huntington Beach, CA --

Signed and Sealed this

Fifteenth Day of October, 2002

*Attest:*

JAMES E. ROGAN
*Director of the United States Patent and Trademark Office*

*Attesting Officer*